US011320143B2

(12) United States Patent
Cassidy

(10) Patent No.: US 11,320,143 B2
(45) Date of Patent: May 3, 2022

(54) FLARE PILOT AND FLARE PILOT WITH IGNITOR ASSEMBLY

(71) Applicant: FLARETECH INC., Stettler (CA)

(72) Inventor: Bo-John Cassidy, Stettler (CA)

(73) Assignee: FLARETECH INC., Stettler (CA)

( * ) Notice: Subject to any disclaimer, the term of this patent is extended or adjusted under 35 U.S.C. 154(b) by 86 days.

(21) Appl. No.: 16/515,919

(22) Filed: Jul. 18, 2019

(65) Prior Publication Data

US 2020/0025372 A1 Jan. 23, 2020

(30) Foreign Application Priority Data

Jul. 18, 2018 (CA) ..... CA 3011695

(51) Int. Cl.
*F23G 7/08* (2006.01)
*F23Q 9/04* (2006.01)
*F23Q 9/00* (2006.01)

(52) U.S. Cl.
CPC ..... *F23G 7/085* (2013.01); *F23Q 9/045* (2013.01); *F23N 2227/26* (2020.01); *F23N 2227/30* (2020.01)

(58) Field of Classification Search
CPC ..... F23D 2900/14003; F23G 7/085; F23N 2227/26; F23N 2227/30; F23Q 9/00; F23Q 9/045
See application file for complete search history.

(56) References Cited

U.S. PATENT DOCUMENTS 1,974,321 A * 9/1934 Toelle ..... 431/53
2,319,676 A * 5/1943 Guelson ..... F23N 5/107 236/21 R
2,384,696 A * 9/1945 Ray ..... F23N 5/105 431/48
2,869,631 A * 1/1959 Zink ..... F23Q 9/00 431/202
2,946,376 A * 7/1960 Thornbery ..... F23N 5/105 431/48
3,155,143 A * 11/1964 Jackson ..... F23Q 9/04 431/80

(Continued)

FOREIGN PATENT DOCUMENTS

ES 294041 A1 * 1/1964
GB 694181 A * 7/1953 ..... F23Q 9/00

*Primary Examiner* — Jorge A Pereiro
*Assistant Examiner* — Logan P Jones
(74) *Attorney, Agent, or Firm* — Sander R. Gelsing

(57) ABSTRACT

In one aspect a pilot assembly is disclosed for use with a flare having a first flare stack and a second flare stack, each having discharge ends. The pilot assembly comprises a pilot nozzle assembly, a pilot inlet pipe having a pilot fuel inlet, and a pilot ignition system. The pilot nozzle assembly comprises a connecting member, a pilot nozzle inlet, a first pilot nozzle and a second pilot nozzle. The pilot nozzle assembly can direct a quantity of pilot gas received via the pilot inlet pipe out through the first and second pilot nozzles. The first and second pilot nozzles may both be positioned adjacent the discharge end of either one of the first or second flare stacks. Alternatively, the first pilot nozzle may be positioned adjacent the first flare stack's discharge, and the second pilot nozzle may be positioned adjacent the second flare stack's discharge end.

8 Claims, 11 Drawing Sheets

(56) References Cited

U.S. PATENT DOCUMENTS

| | | | | | |
|---|---|---|---|---|---|
| 3,302,687 | A * | 2/1967 | Gjerde | F23Q 9/00 | 431/266 |
| 4,127,380 | A * | 11/1978 | Straitz, III | F23G 7/085 | 431/15 |
| 4,741,691 | A * | 5/1988 | Messimer | F23D 14/725 | 431/202 |
| 4,834,644 | A * | 5/1989 | Snow | F23N 1/022 | 431/1 |
| 2013/0309616 | A1* | 11/2013 | Kodesh | F23K 5/002 | 431/5 |
| 2015/0204542 | A1* | 7/2015 | Tolstoukhov | F23G 7/06 | 431/5 |
| 2015/0338100 | A1* | 11/2015 | Deng | F23Q 9/02 | 431/59 |

* cited by examiner

*Fig. 1 - PRIOR ART*

*Fig. 2 - PRIOR ART*

*Fig. 3 - PRIOR ART*

FLARE PILOT AND FLARE PILOT WITH IGNITOR ASSEMBLY

FIELD OF THE INVENTION

This invention relates generally to flares. More particularly, the invention relates to improved flare pilots, flare pilot nozzles and flare pilot with ignitor assemblies.

BACKGROUND OF THE INVENTION

The background information discussed below is presented to better illustrate the novelty and usefulness of the present invention. This background information is not admitted prior art.

A variety of apparatus for flaring combustible waste fluid streams have been developed and used in the past. Such apparatus are often referred to as flares or flare stacks. Flares dispose of waste fluids, such as hydrocarbon gasses, in an environmentally compliant manner through the use of combustion. Flares are commonly located at production, refining and other processing plants. They are a critical component of a system design intended for safely disposing of combustible wastes or other combustible streams, such as hydrocarbons from pressure-relieving and vapour-depressurizing systems. Multiple flare stacks, e.g. dual or triple flare stacks, may be provided together at a site and anchored in place using guy wires and anchors (e.g. see FIG. 1 for an example of a dual flare stack).

Referring to FIGS. 1-3, each flare stack generally includes one or more pilots (sometimes also referred to as pilot lights). Pilots are small, continuously operating burners that provide ignition energy (in the form of a pilot flame) to ignite and/or stabilize the combustion of the flared waste fluids being combusted by the flare. They typically comprise a fuel-air mixture discharge nozzle or pilot nozzle. The pilot nozzle is positioned in close proximity to the flare's discharge end, so as to direct a pilot flame over the discharge end. This pilot nozzle may be connected to a pilot inlet pipe, such as by welding or a threaded connection. The pilot inlet pipe receives pilot fuel or pilot gas from a gas source (not shown); e.g. via a pilot fuel inlet. The pilot inlet pipe then directs that fuel to the pilot nozzle for combustion adjacent the flare's discharge end.

A flame front generator is a commonly used pilot ignition system for lighting and relighting a pilot by means of a flame front. The flame front generator mixes air and fuel gas into an ignition chamber. A spark plug (or other ignition source) ignites this mixture creating the "flame front", which is then directed or propagated through an ignition line (typically a 1" pipe), out a flame front nozzle and directed to the flare pilot so as to ignite the pilot gas. Both compressed-air flame-front generators and inspirating flame-front generators are known in the art. The combination of pilot nozzle and adjacent flame front nozzle, along with their respective pilot inlet pipe and ignition line, may be referred to as a pilot assembly (see FIGS. 2 and 3).

By using an ignition line, the flame front generator can be placed lower down on the flare stack, so as to allow maintenance to be performed at or near grade, or to lower the generator at least some distance down from the flare's tip and discharge end. When the flame front exits the flame front nozzle it ignites the pilot fuel discharged from the pilot nozzle. After the pilot is ignited, the flame front generator is shut-off. Additionally, and unlike pilots used in boilers or process heaters, the flare pilot or sparking device cannot be replaced or serviced while the flare is in operation. Consequently, having an ignition system placed away from the discharge end is generally recommended.

One prevalent flare pilot ignition system is the compressed-air flame-front generator. With this system, compressed air and fuel are metered through orifices into a mixing chamber located at (or closer to) grade. Downstream of the mixing chamber there is a sparking device and piping which connects the mixing chamber and sparking device to the pilot. During operation the flow of combustible gas is established and then ignited. This sends a flame front through the ignition line to the flame front nozzle. The flame front nozzle directs the flame front to the pilot nozzle where it then ignites the pilot. The principal advantage of the compressed-air flame-front generator is that the flow controls and the sparking device are at (or closer to) grade and that they can be serviced while the flare is in operation. A further advantage of compressed-air flame front generators is that additional (air) pressure can be generated which allows for extended piping lengths and distances.

Similarly, another prevalent flare pilot ignition system is shown in FIGS. 1-3 wherein the flame front generator is located some distance from the pilot nozzle by means of the ignition line. An orifice and venturi system within the flame front generator is utilized to receive pilot fuel gas and atmospheric air, and then direct an appropriate air/fuel mixture needed for the flame front into the ignition line. A thermocouple in or near the pilot nozzle may sense that temperature of the pilot nozzle is below a predetermined level, indicating pilot is out. The thermocouple can then trigger a solenoid to open a valve to direct fuel into the flame front generator. A time delay may be set so as to allow sufficient fuel to fill the ignition line; after which a spark is generated by the flame front generator. This spark then causes the fuel within the ignition line to ignite so that a flame front works its way along the ignition line and out the flame front nozzle. The thermocouple may then sense that pilot is lit and shut off solenoid and fuel supply to the flame front generator.

Typically each pilot will have its own flame front flame front nozzle. This is because a flame front will quickly dissipate and extinguish upon exiting the flame front nozzle. Thus, to reliably light and re-light a pilot, the flame front nozzle must be closely and appropriately positioned so as to direct the flame front adjacent and, preferably, into the pilot nozzle before a flame front extinguishes or is quenched prior to igniting the pilot fuel gas. Windshields or shrouds are also commonly provided around a pilot, to avoid flame-outs during bad/stormy weather. A gas stripper, which is typically a small tab or opening in the flare stack, may also be strategically placed to direct some of the waste fluids from within the flare stack into the shroud, to assist with ignition of the waste fluids by the pilot.

To allow for ease of servicing the pilot assemblies (i.e. the pilot nozzle and adjacent flame front nozzle, along with their respective pilot inlet pipe and ignition line) and any flame front generator(s), they may be provided on a pilot retracting assembly or system (see FIG. 2). The pilot retracting assembly typically comprise a pilot retracting track, to which the pilot assembly is rollably mounted (e.g. via rollers), in a conventional manner. A conventional winch, cable and pulley system is then employed to adjustably position the pilot assembly between the discharge end of the flare stack (e.g. during operation) and a lowered position (e.g. during maintenance). Thus, retracting a pilot assembly and/or flame front generator is then a simple process and makes any maintenance easily completed, without having to shut down flare operation.

However, as the diameter of a flare's discharge end increases, various safety codes (e.g. CSA B149.3-15 or API 537) and safety practices now require an increased number of pilots per flare. For example, a flare having a discharge end with a diameter of 8 inches or less may be fine with a single pilot, while a flare having a discharge end with a diameter between 8 and 24 inches may require at least two pilots. Still larger discharge ends, e.g. greater than 42 inches, may require 4 or more separate pilots. For example, and as can be seen from FIG. 2, there are five (5) pilot assemblies shown on the dual flare stack; two on flare stack 1 and three on flare stack 2. As such, there are also five (5) pilot retracting systems and five (5) pilot retracting tracks. Not only does this add to the manufacturing cost of a flare stack, but it becomes more and more difficult to located and mount additional pilot retracting assemblies (and pilot retracting tracks) on a large diameter flare stack, which may require 4 or more pilots.

Therefore, what is needed is an apparatus or system that allows for multiple pilots, which can still be retracted but eliminates or reduces the need for multiple pilot retracting assemblies and pilot retracting tracks.

SUMMARY OF THE INVENTION

In one aspect there is provided a pilot assembly comprising a pilot nozzle assembly, a pilot inlet pipe having a pilot fuel inlet, and a pilot ignition system. The pilot nozzle assembly comprises a connecting member, a single pilot nozzle inlet, and a plurality of nozzle outlets. The pilot nozzle assembly is in fluid communication with said pilot inlet pipe.

In another aspect there is provided a pilot assembly for use with a flare stack having a first flare stack and a second flare stack. Each of the first flare stack and a second flare stack comprise a flare having a discharge end. The pilot assembly comprises a pilot nozzle assembly, a pilot inlet pipe having a pilot fuel inlet, and a pilot ignition system. The pilot nozzle assembly comprises a connecting member, a single pilot nozzle inlet, and a plurality of nozzle outlets. The pilot nozzle assembly is in fluid communication with the pilot inlet pipe. The pilot nozzle assembly further comprises a first pilot nozzle and a second pilot nozzle. The connecting member comprises a plurality of conduits fluidly connecting the pilot nozzle inlet to the first pilot nozzle and the second pilot nozzle. The first pilot nozzle may be positioned adjacent the discharge end of the first flare stack. The second pilot nozzle may be positioned adjacent the discharge end of the second flare stack.

In yet another aspect there is provided a pilot nozzle assembly for use with a pilot assembly of a flare stack having a flare with a discharge end. The pilot nozzle assembly comprises a connecting member, a single pilot nozzle inlet, a plurality of nozzle outlets, and at least two pilot nozzles. Each of the pilot nozzles terminates in one of said plurality of nozzle outlets. The connecting member comprises a plurality of conduits fluidly connecting the pilot nozzle inlet and the pilot nozzles. The plurality of nozzle outlets may be directed to said discharge end of the flare.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF THE PREFERRED EMBODIMENTS

Figure 1:
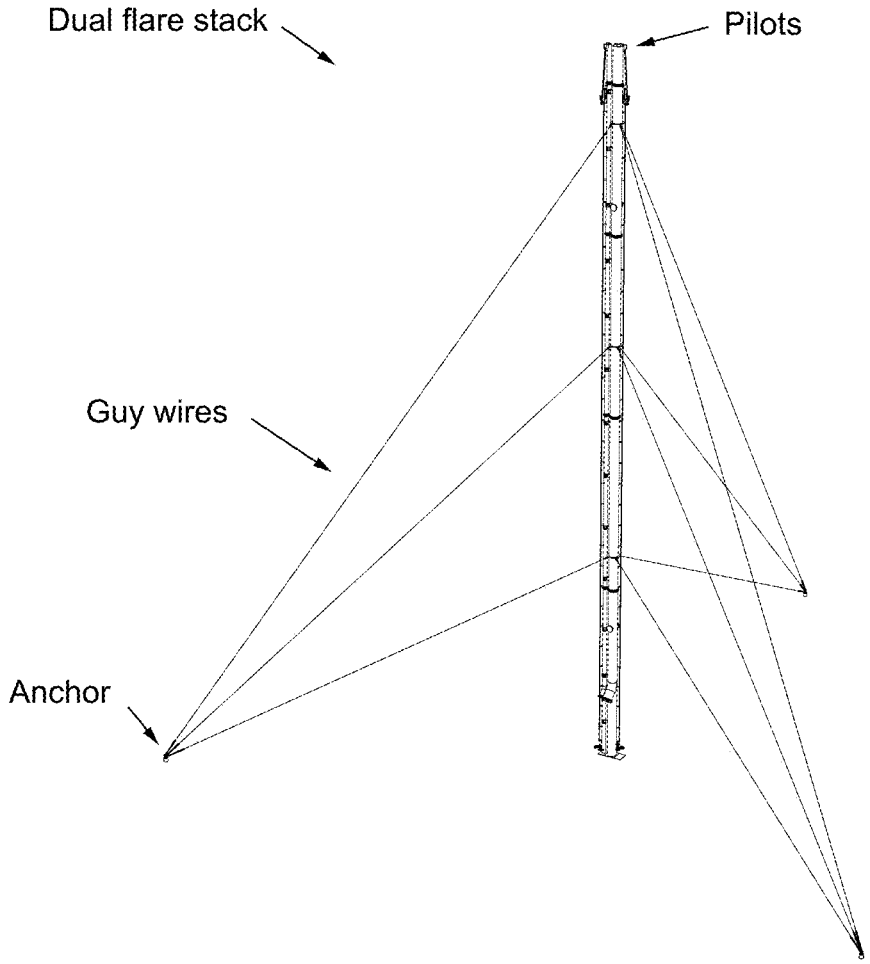
FIG. 1 is a perspective view of a dual flare stack having PRIOR ART flare pilots.

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

A first embodiment of a pilot assembly 100 of the present invention is shown in FIGS. 4-7. The pilot assembly 100 preferably comprises a pilot nozzle assembly 102, a single pilot inlet pipe 110 having a pilot fuel inlet 120, and a pilot ignition system 30. The pilot nozzle assembly 102 is in fluid communication with said single pilot inlet pipe 110. During operation, and as conventional, the pilot assembly 102 receives pilot fuel or pilot gas from a gas source (not shown) via pilot inlet pipe 110 and pilot fuel inlet 120; e.g. via a fuel hose (not shown) connecting the gas source to the pilot fuel inlet 120. Pilot ignition system 30 preferably comprises a flame front generator 32, a single ignition line 34, and at least one flame front nozzle 36. During operation, pilot ignition system 30 can be actuated to ignite the pilot fuel or pilot gas in a substantially conventional manner (via a flame front) and light the pilot flame (PF).

Pilot nozzle assembly 102 preferably comprises a body or connecting member 103, a single pilot nozzle inlet 104 and a plurality of nozzle outlets 106. More preferably, pilot nozzle assembly 102 comprises dual pilot nozzles 102*a*, 102*b* each terminating in their respective nozzle outlet 106*a*, 106*b*. Body or connecting member 103 may comprise a plurality of legs or conduits 103*a*, 103*b* between inlet 104 and the nozzles 102*a*, 102*b*. One or more thermal well guides or inlets 150 may be provided on body 103 to receive a conductive wire or lead 152 to connect a thermocouple that may be within assembly 102 to the pilot ignition system (see also FIGS. 14*a*-15*b*). As illustrated in FIGS. 4-7, connecting member 103 and pilot nozzles 102 are each preferably generally tubular members. Pilot nozzle assembly 102 is preferably made from metal, steel or any other suitable material that provides adequate strength and durability to allow said assembly 102 to operate as a pilot and withstand the heat, flames and high temperatures typically encountered by the assembly 102 during flare stack 12 operations.

Preferably, the pilot nozzle assembly 102 of the embodiment shown in FIGS. 4-7 preferably comprises a body or connecting member 103 to fluidly connect plurality of pilot nozzles 102*a*, 102*b* to said pilot nozzle inlet 104 (via legs or conduits 103*a*, 103*b*). Body 103 preferably receives pilot gas from said single pilot inlet pipe 110 (via inlet 104) and then directs all, or substantially all, of said pilot gas to said plurality of pilot nozzles 102*a*, 102*b*, via legs or conduits 103*a*, 103*b*. The plurality of pilot nozzles 102*a*, 102*b* then direct all, or substantially all of said pilot gas out through their respective nozzle outlets 106*a*, 106*b*. More preferably, the body 103 and plurality of pilot nozzles 102*a*, 102*b* are of such dimensions (including inside diameter passages) so as to substantially evenly direct said pilot gas to each of said plurality of pilot nozzles 102*a*, 102*b* and their respective outlets 106*a*, 106*b*; i.e. so as to have the amount of pilot gas flow (volume, flow rates and pressures) be substantially the same at each of the plurality of nozzle outlets 106.

The plurality of pilot nozzles 102*a*, 102*b* may each be provided with one or more flame front openings 108 to allow some of the pilot gas to exit the pilot nozzles 102*a*, 102*b* prior to the bulk of said pilot gas being directed to discharge from outlets 106*a*, 106*b* and/or to allow a flame front FF (which may exit from flame front nozzle 36) to enter into the interior of said nozzles 102*a*, 102*b*, thereby facilitating ignition of the pilot gas by said flame front FF during operation and ignition procedures and light the pilot flame PF.

A plurality of flare pilot assemblies 100 may be provided and mounted on one or more flare stacks 10 having a flare 12 with a discharge end 18. Flare 12 may be connected to stack 14 by means of a flanged connection 16. A gas stripper 17 is preferably provided to direct some of the waste fluids within the flare 12 to the nozzle assembly 100, to assist with the combustion and ignition of said waste fluids by the pilot assemblies 100. A wind shroud 19 is preferably provided to reduce or eliminate flame-outs of the pilot flame PF during bad/stormy weather. The flare stack 10 may be a dual flare stack, as shown in FIGS. 4-7 and FIGS. 13*a*-13*g*, comprising a first flare stack 10*a* and a second flare stack 10*b*. In the embodiments of FIGS. 4-7 and in FIGS. 13*a*-13*g*, the first flare stack 10*a* and a second flare stack 10*b* each comprise a flare 12 having a discharge end 18 and connected to a stack 14 via a flanged connection 16.

Figure 4:
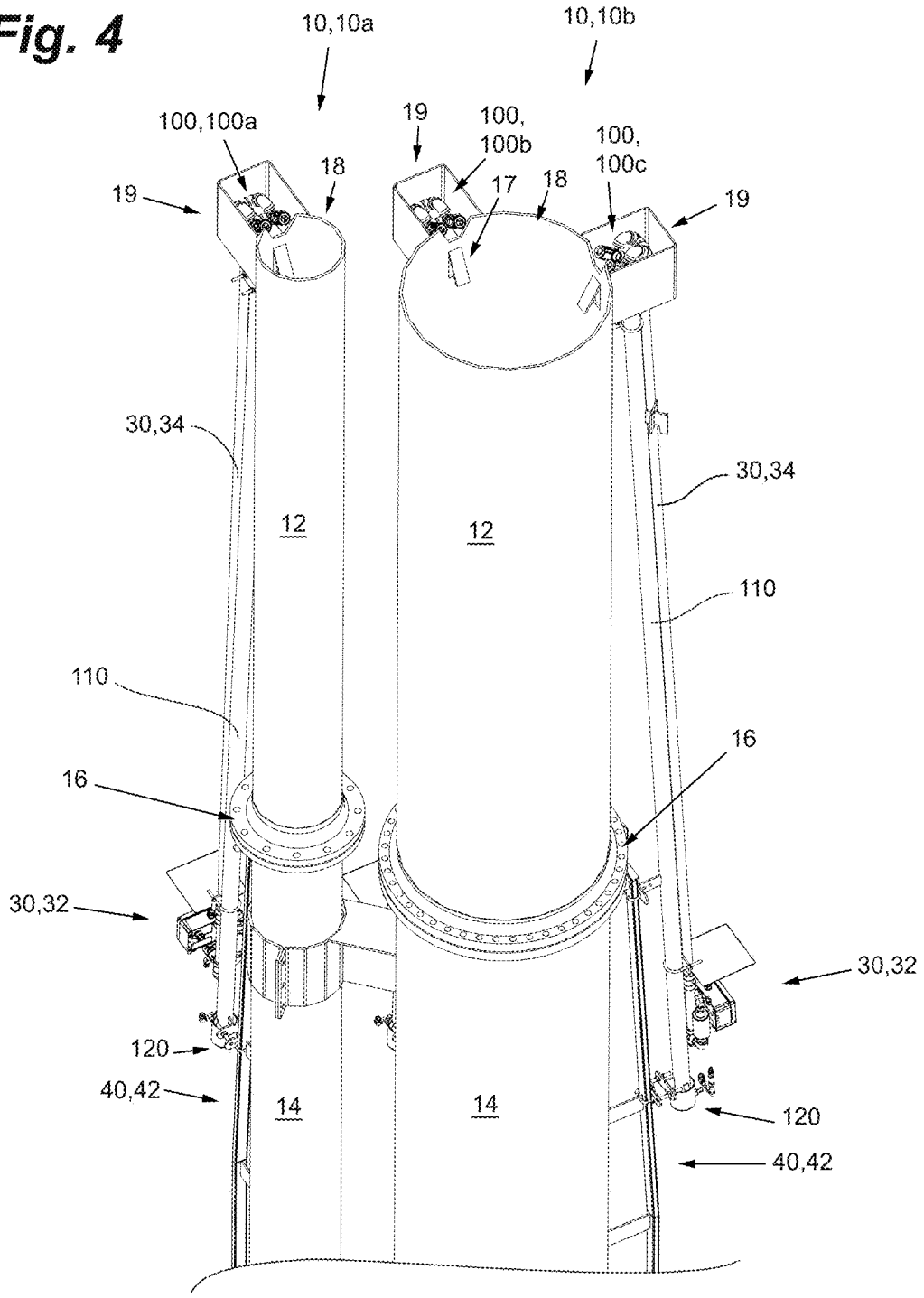
FIG. 4 is a top perspective view of one embodiment of a flare pilot, shown mounted in multiple locations on a dual flare stack.
Figure 5:
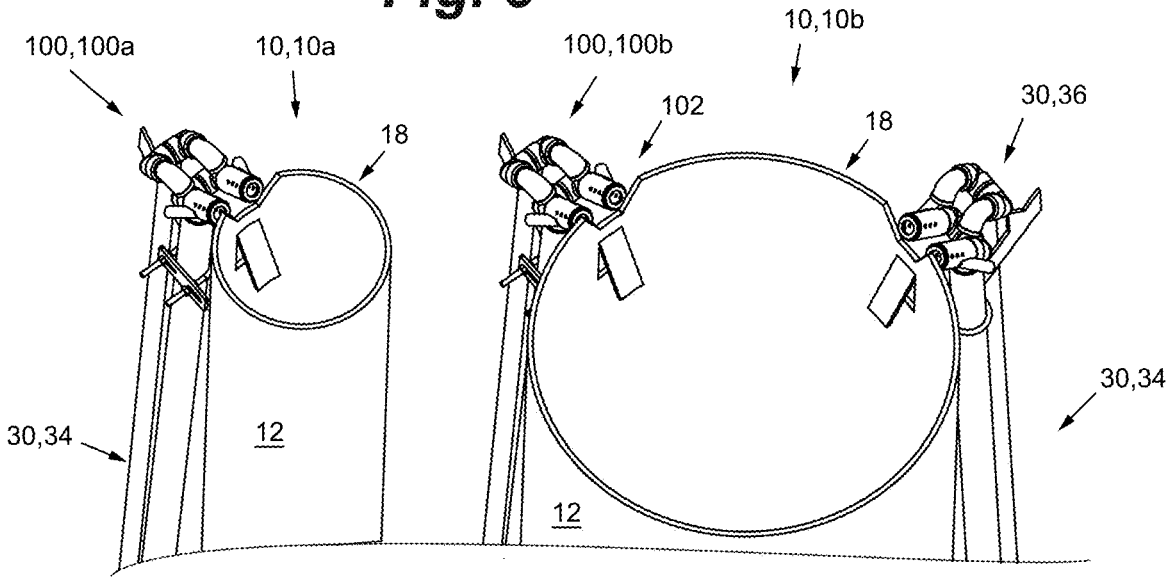
FIG. 5 is a close-up view of the top of the dual flare stack of FIG. 4, with the wind shrouds removed so as to more clearly show the novel flare pilots of the present invention.
Figure 6:
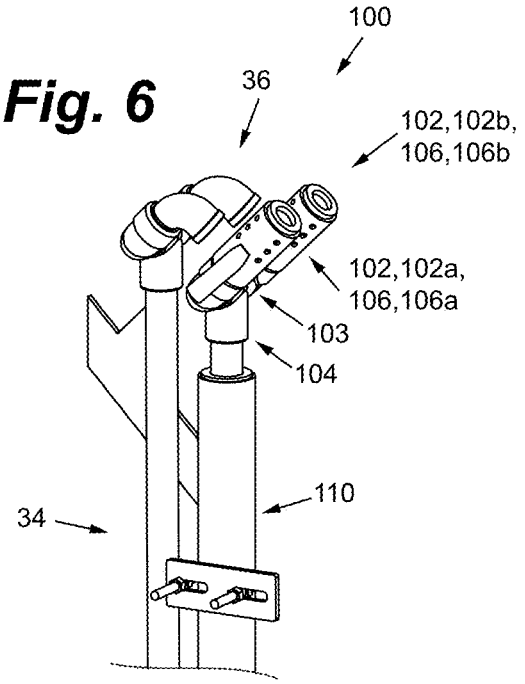
FIGS. 6 and 7 are close-up, side perspective views of the flare pilots of the embodiment of FIG. 4.
Figure 7:
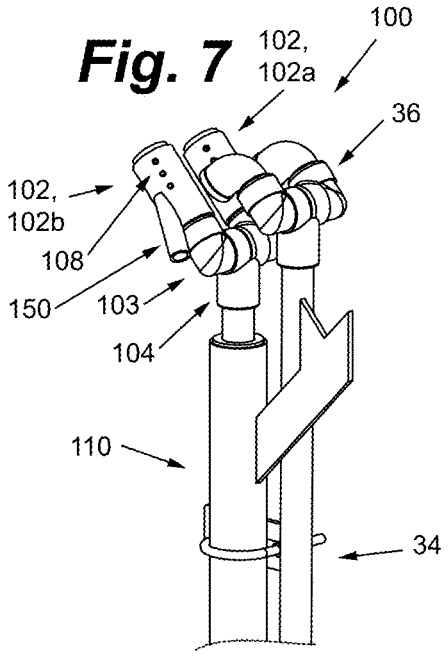
Figure 8A:
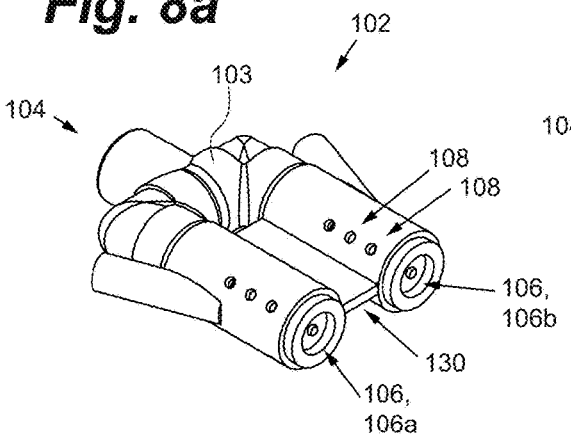
FIGS. 8*a* and 8*b* are perspective views of a second embodiment of a flare pilot nozzle of the invention.
Figure 8B:
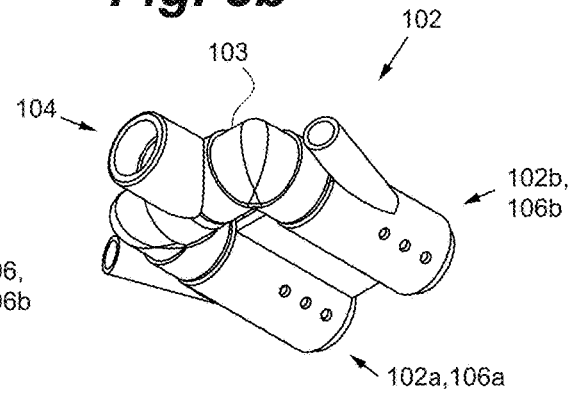
Figure 9A:
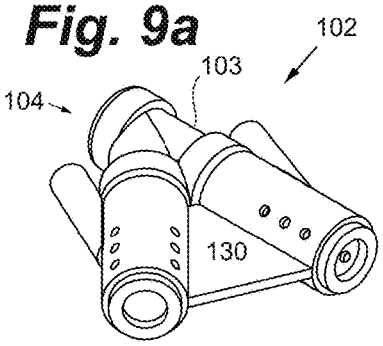
FIGS. 9*a* and 9*b* are perspective views of a third embodiment of a flare pilot nozzle of the invention.
Figure 9B:
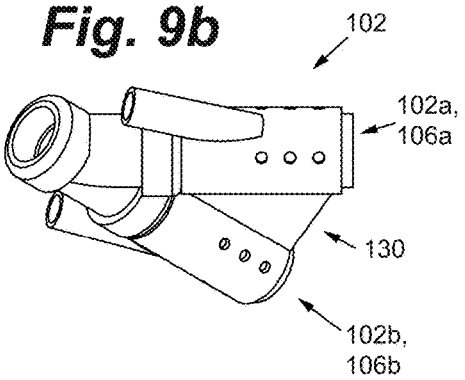
Figure 10A:
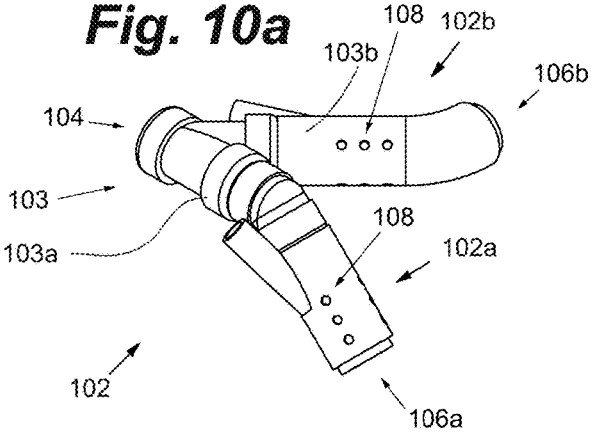
FIGS. 10*a* and 10*b* are perspective views of a fourth embodiment of a flare pilot nozzle of the invention.
Figure 10B:
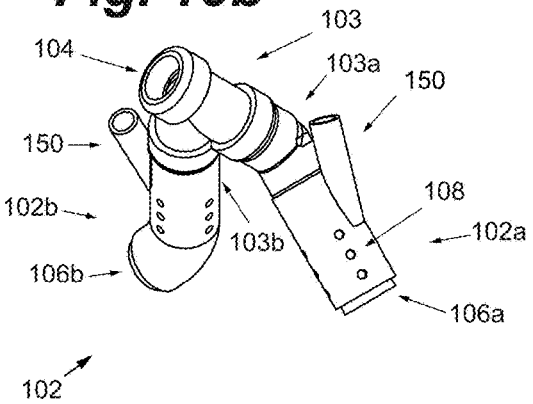
Figure 11A:
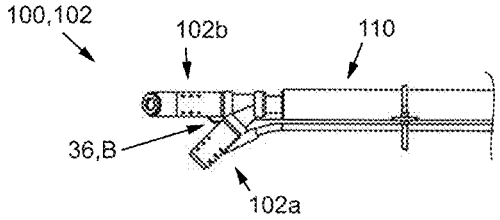
FIGS. 11*a*, 11*b* and 11*c* are bottom, right-side and top views of a flare pilot illustrating a fifth embodiment of a flare pilot nozzle of the invention.
Figure 12A:
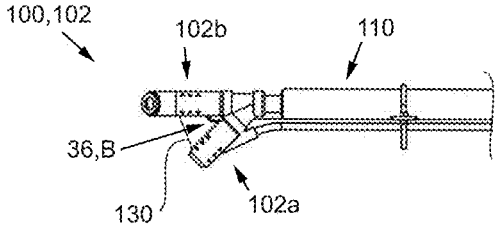
FIGS. 12*a*, 12*b* and 12*c* are bottom, right-side and top views of a flare pilot illustrating a sixth embodiment of a flare pilot nozzle of the invention.
Figure 11B:
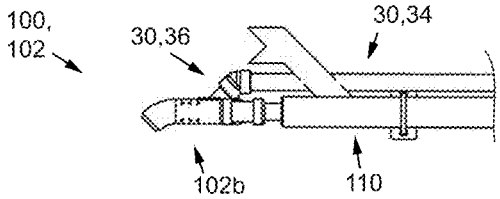
Figure 12B:
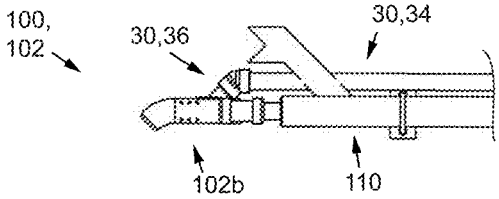
Figure 11C:
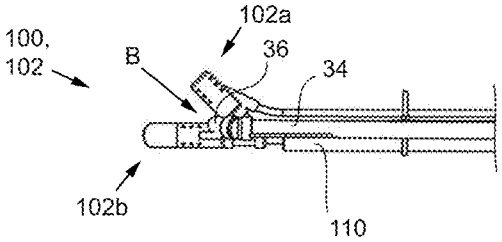
Figure 12C:
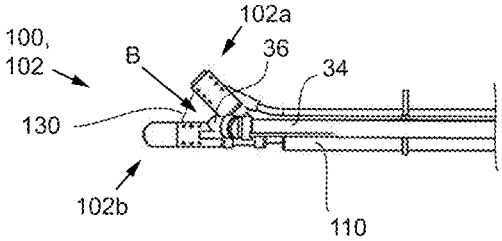
Figure 13A:
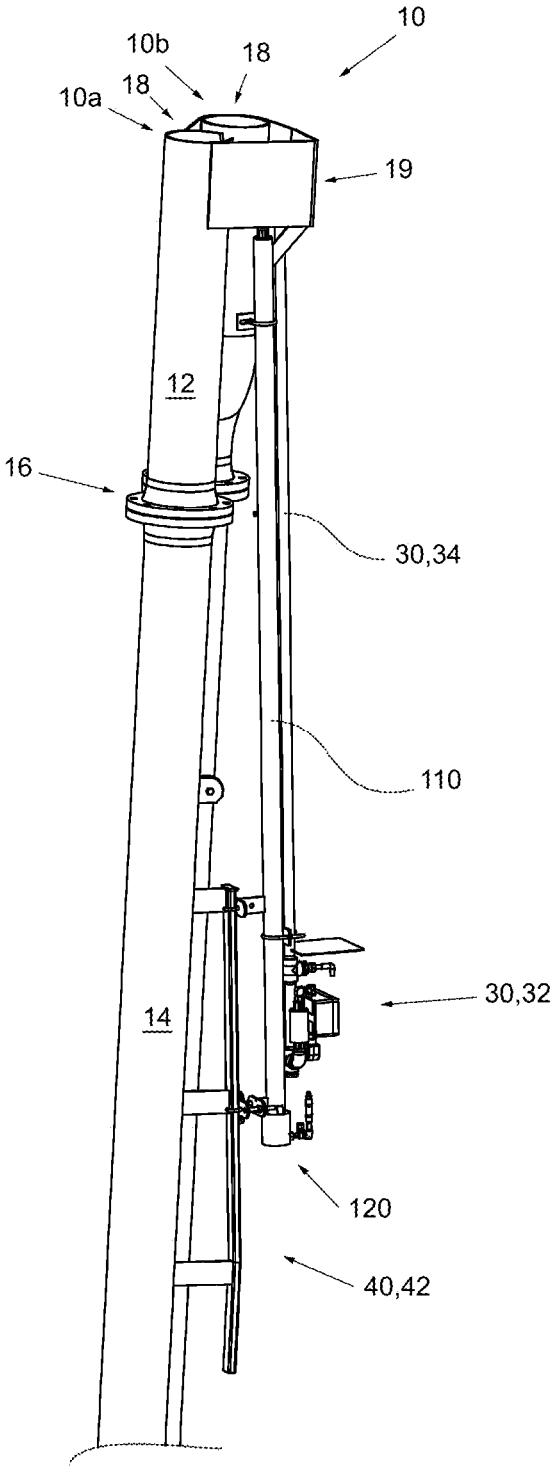
FIG. 13*a* is a side perspective view of a seventh embodiment of a flare pilot with ignitor assembly, shown mounted in between the two flares of a dual flare stack.
Figure 13B:
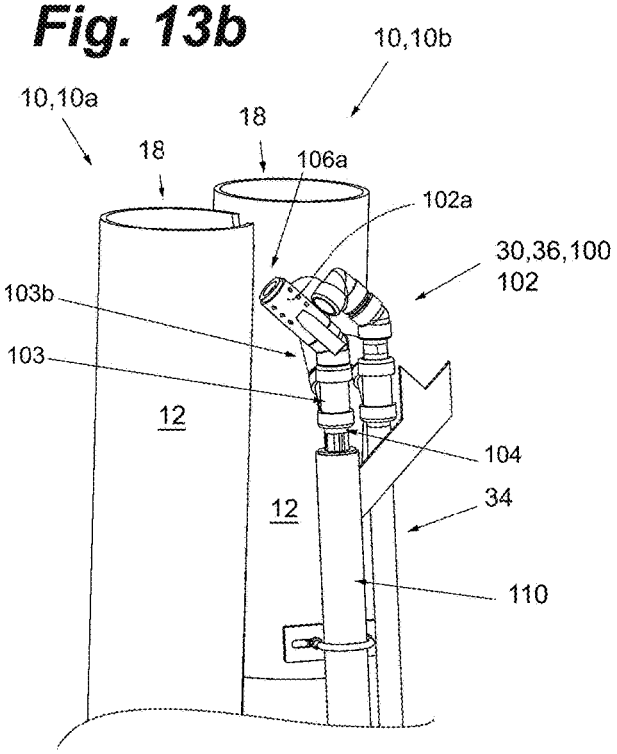
FIGS. 13*b*-13*e* are a close-up perspective views of the dual flare stack of FIG. 13*a*, with the wind shroud removed so as to more clearly show the novel flare pilot and ignitor assembly of the present invention.
Figure 13C:
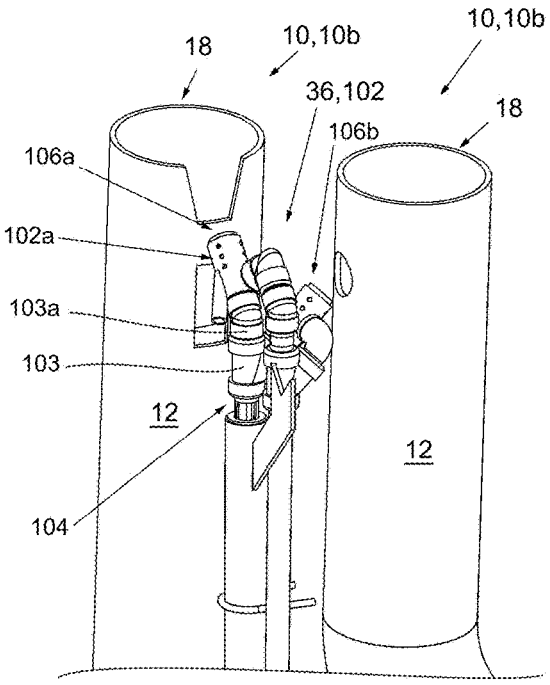
Figure 13D:
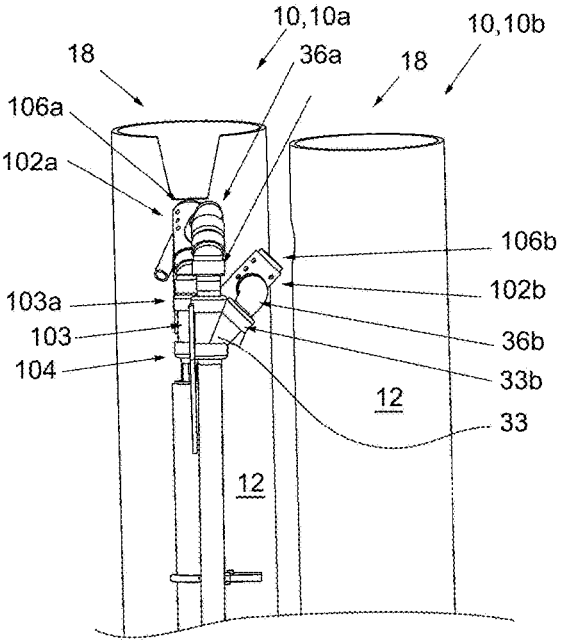
Figure 13E:
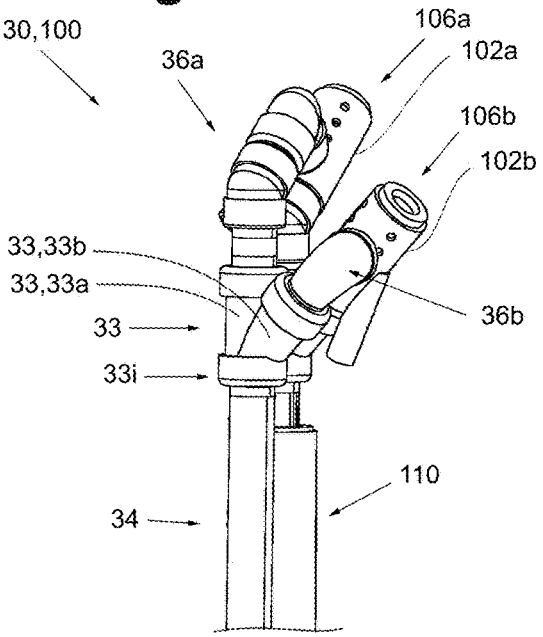
Figure 13F:
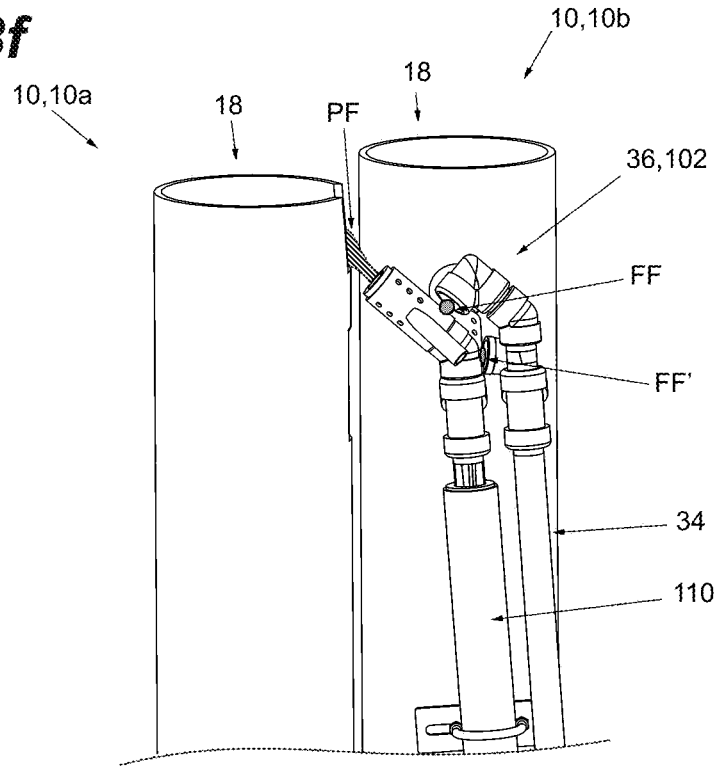
FIGS. 13*f*-13*g* are a close-up perspective views of the dual flare stack of FIG. 13*a*, showing the flare pilot and ignitor assembly of the present invention being ignited by a flame front and with the pilot flame lit.
Figure 13G:
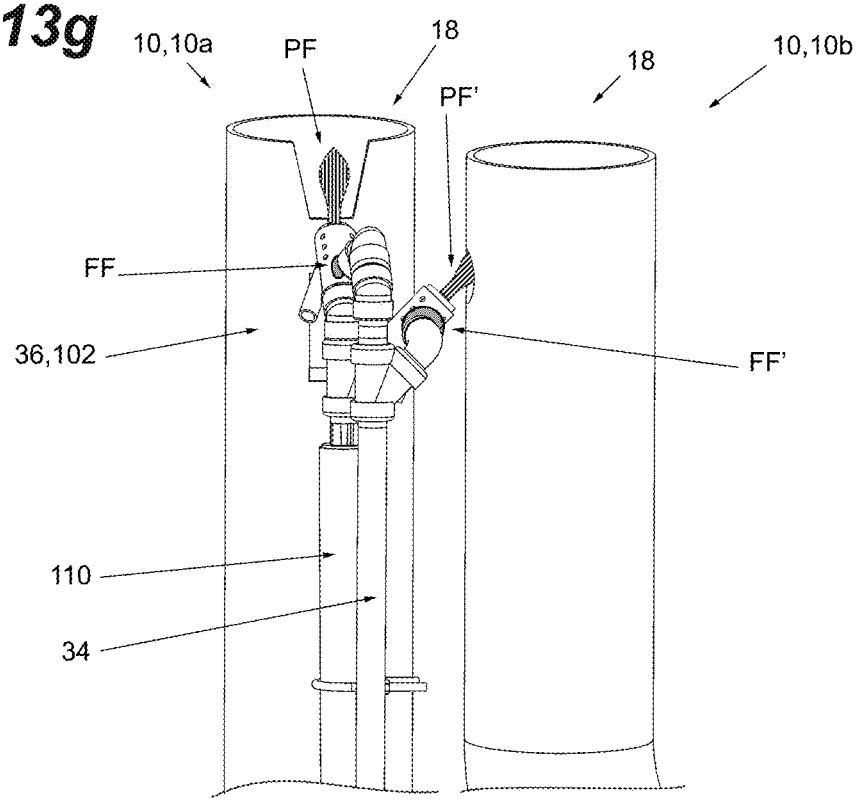
Figure 14A:
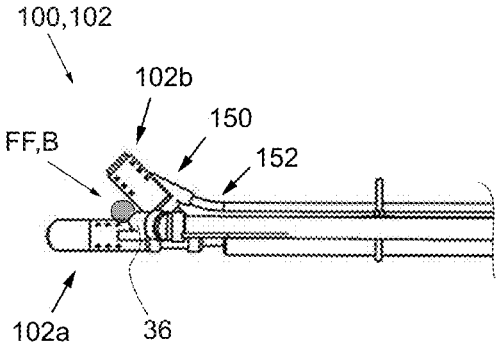
FIGS. 14*a*-14*b* are top views of the flare pilot embodiment of FIGS. 11*a*-11*c*, showing a flame front (FIG. 14*a*) lighting the pilot's pilot flame (FIG. 14*b*)
Figure 14B:
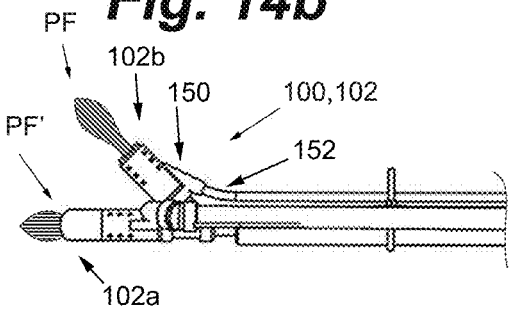

In the embodiments of FIGS. 4-7, three flare pilot assemblies 100*a*, 100*b*, 100*c* are provided—one such assembly 100*a* on the first flare stack 10*a* and two such assemblies 100*b*, 100*c* on the second flare stack 10*b* (see FIG. 4). Each of these flare pilot assemblies 100*a*, 100*b*, 100*c* is rollably mounted in a conventional manner to their respective flare stack 10*a*,10*b*; i.e. by means of a pilot retraction system 40, comprising a pilot retracting track 42 (see FIG. 4). A conventional winch, cable and pulley system (not shown) is employed to adjustably position the flare pilot assemblies 100*a*, 100*b*, 100*c* between the discharge end 18 of the flare stack 10 (e.g. during operation) and a lowered position (e.g. during maintenance). Since there are three (3) flare pilot assemblies 100*a*, 100*b*, 100*c*, there are three (3) corresponding pilot retraction systems 40 and pilot retracting tracks 42 (one on the first flare stack 10*a*, and two on the second flare stack 10*b*).

Figure 2:
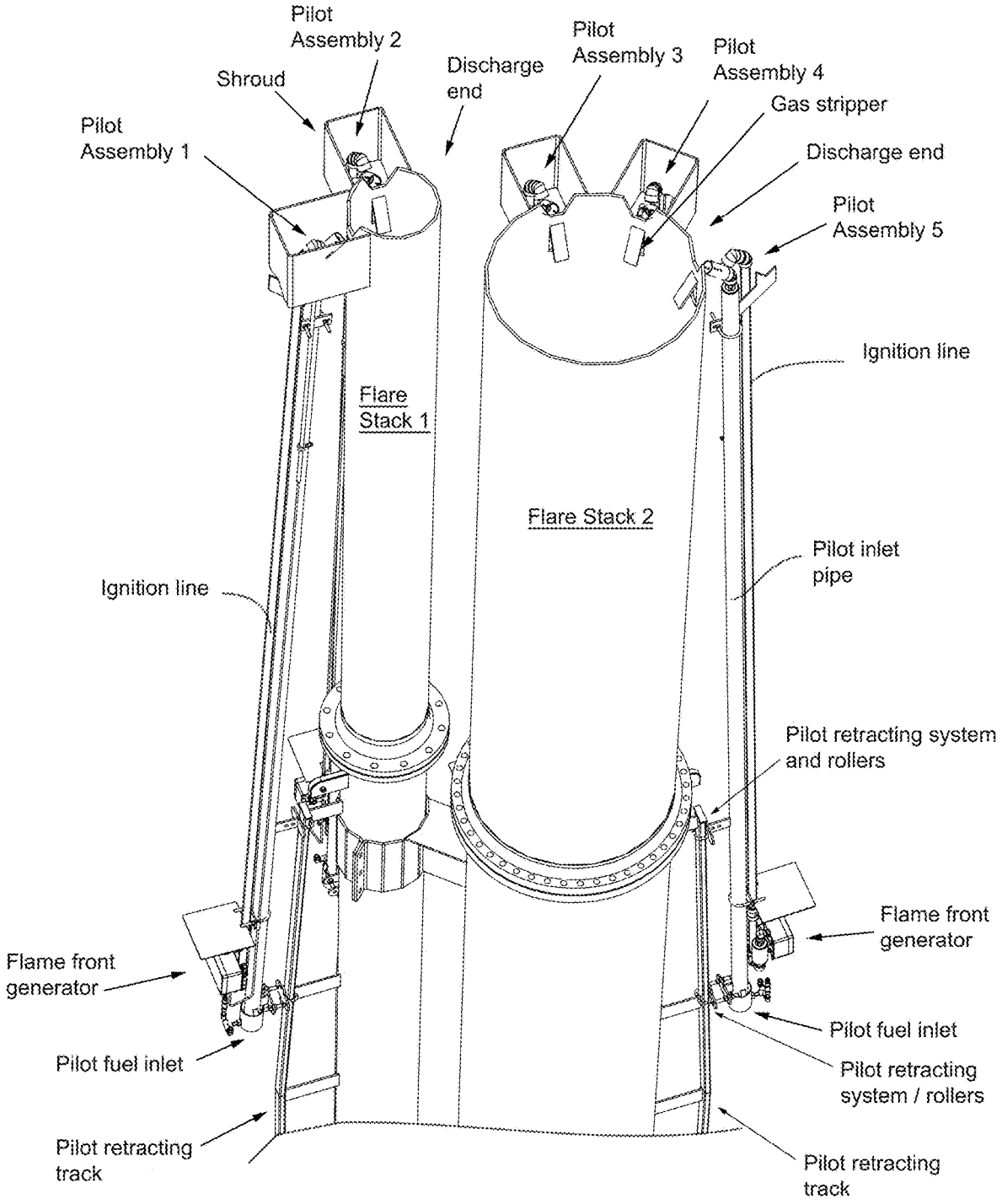
FIG. 2 is a top perspective view of the PRIOR ART flare pilots in the dual flare stack of FIG. 1.
Figure 3:
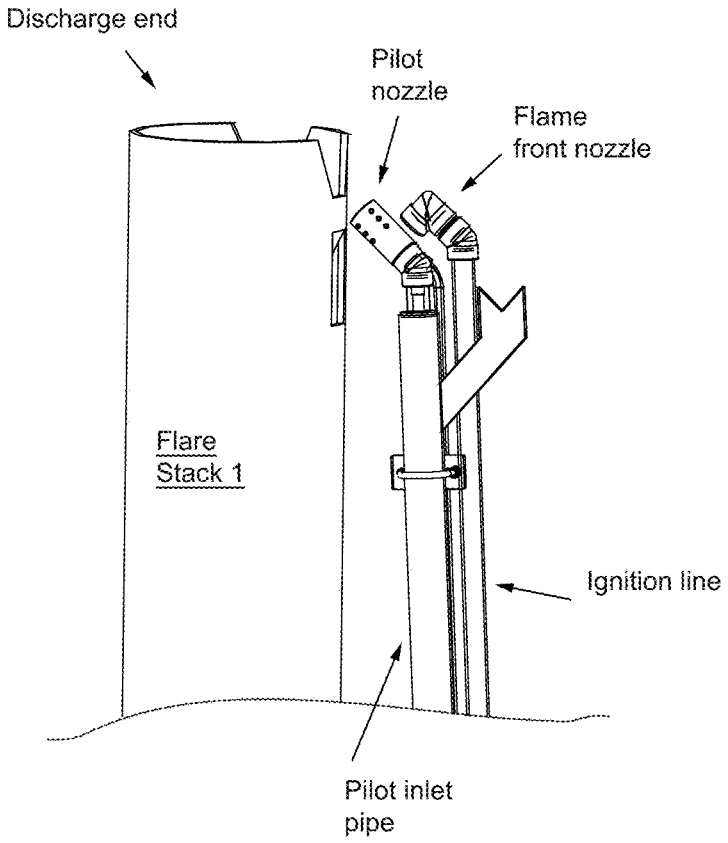
FIG. 3 is a close-up, top-side, perspective view of PRIOR ART flare pilot for flare stack 1 of the dual flare stack of FIG. 1.

Advantageously, the flare pilot assemblies 100*a*, 100*b*, 100*c* of this embodiment provide for a total of six (6) separate pilot nozzles 102 and nozzle outlets 106; and the ability to direct six (6) pilot flames over the discharge ends 18—i.e. two (2) on the first flare stack 10*a*, and four (4) on the second flare stack 10*b*. More advantageously, only three (3) pilot retraction systems 40 and pilot retracting tracks 42 are needed to mount these six nozzles 102. Therefore, as compared to the prior art system shown in FIG. 2, where five (5) pilot nozzles were mounted on five (5) pilot retracting systems, this embodiment not only provides additional pilot nozzles (six nozzles versus five in the prior art version), but requires significantly less pilot retracting systems and retracting racks (three versus five).

Now referring to the embodiment of FIGS. 13*a*-13*g*, a single flare pilot assembly 100 is shown mounted on a dual flare stack. The flare pilot assembly 100 is rollably mounted in a conventional manner to one of the flare stacks 10*a*; i.e. by means of a single pilot retraction system 40, comprising a pilot retracting track 42 (see FIG. 13*a*). A conventional winch, cable and pulley system (not shown) is employed to adjustably position the flare pilot assembly 100 between the discharge end of the flare stack 18 (e.g. during operation) and a lowered position (e.g. during maintenance). The flare pilot assembly 100 of this embodiment provides two separate pilot nozzles 102*a*, 102*b* and two nozzle outlets 106*a*, 106*b*; and the ability to direct a pilot flame PF' over the discharge ends 18 of each of the two flare stacks 10*a*,10*b*. Advantageously, only a single pilot retraction system 40 is required to mount two separate pilot nozzles 102*a*, 102*b* over two flare stacks 10*a*, 10*b*.

In the embodiment of FIGS. 13*a*-13*g*, and to facilitate ignition of the pilots, the flame front nozzle 36 further comprises a nozzle body or connecting member 33, a single nozzle inlet 33*i*, a first leg 33*a*, a second leg 33*b* and a plurality of nozzle outlets 36*a*, 36*b*. More preferably, flame front nozzle 36 comprises dual nozzle outlets 36*a*, 36*b* each oriented so as to direct a flame front FF, FF' onto each of the associated nozzle outlet 106*a*, 106*b* of the pilot nozzle assembly 102 (see FIGS. 13*f*, 13*g*). Flame front nozzle body 33, first leg 33*a*, second leg 33*b* and flame front nozzles 36 are each preferably generally tubular members. Flame front nozzle 36, first leg 33*a*, second leg 33*b* and body 33 are preferably made from metal, steel or any other suitable material that provides adequate strength and durability to allow them to withstand the heat, flames and high temperatures typically encountered during flare stack and pilot ignition operations.

Preferably nozzle body 33 fluidly connects plurality of nozzle outlets 36*a*, 36*b* to the nozzle inlet 33*i*, via first and second legs 33*a*, 33*b* respectively. Nozzle body 33 preferably receives a flame front from the ignition line 34 (via nozzle inlet 33*i*) and then directs all, or substantially all, of said flame front to said plurality of nozzle outlets 36*a*, 36*b* (via first and second legs 33*a*, 33*b*). More preferably, the nozzle body 33, first and second legs 33*a*, 33*b* and plurality of nozzle outlets 36*a*, 36*b* are of such dimensions (including inside diameter passages) so as to substantially evenly direct a flame front (from the ignition line 34) out from each of said plurality of nozzle outlets 36*a*, 36*b* so as to produce a plurality of flame front FF, FF'.

Advantageously, first and second legs 33*a*, 33*b* may be of such dimensions and orientations so as to provide a flame front nozzle outlet 36*a*, 36*b* in close proximity to a corresponding or associated pilot nozzle outlet 106*a*, 106*b*, thereby ensuring that a flame front FF, FF' is directed to each of said pilot nozzle outlets 106*a*, 106*b* during pilot ignition operations (see FIGS. 13*f*-13*g*), so as to ensure reliable lighting of all of the nozzle outlets 106 of the pilots. Preferably, flame front nozzle outlets 36*a*, 36*b* are positioned within 2 inches from each of the associated pilot nozzle outlet 106*a*, 106*b*, so as to increase the likelihood that the flame fronts FF, FF' will successfully ignite the pilot to produce pilot flames PF, PF' from each of said pilot nozzles 102*a*, 102*b*.

Figure 15A:
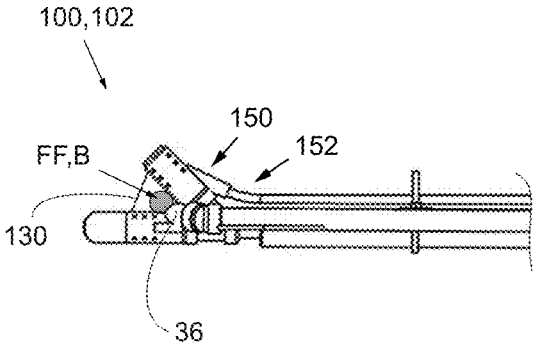
FIGS. 15*a*-15*b* are top views of the flare pilot embodiment of FIGS. 12*a*-12*c*, showing a flame front (FIG. 15*a*) lighting the pilot's pilot flame (FIG. 15*b*)
Figure 15B:
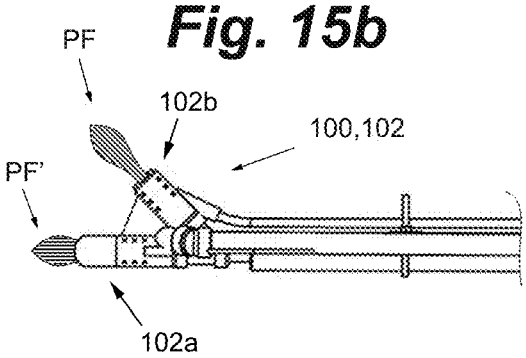

In the embodiment of FIGS. 14*a*-15*b*, and to facilitate ignition of two adjacent pilot nozzles 102*a*, 102*b* via a single flame front nozzle 36, said single flame front nozzle 36 is positioned so as to direct the flame front FF at a point B substantially between and adjacent to said pilot nozzles 102*a*, 102*b* (as illustrated), and preferably no further than 2 inches from each of said pilot nozzles 102*a*, 102*b*, so as to increase the likelihood that a flame front FF will successfully ignite the pilot to produce pilot flames PF, PF' from each of said pilot nozzles 102*a*, 102*b*. Preferably, and as shown in the embodiment of FIGS. 15*a*-15*b*, a flame front deflector 130 is provided between said pilot nozzles 102*a*, 102*b* to direct or deflect the flame front FF towards both said pilot nozzles 102*a*, 102*b*. Flame front deflector 130 is preferably a planar member made from metal, steel or any other suitable material that provides adequate strength and durability to allow it to withstand the heat, flames and high temperatures from a flame front FF. A flame front deflector 130 is similarly provided in the embodiments of FIGS. 8*a*-9*b*.

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

The embodiments of the invention in which an exclusive property or privilege is being claimed are defined as follows:

1. A pilot assembly (100) comprising:
a pilot nozzle assembly (102);
a pilot inlet pipe (110) having a pilot fuel inlet (120); and
a pilot ignition system (30);
wherein the pilot nozzle assembly (102) comprises:
a connecting member (103);
a single pilot nozzle inlet (104); and
a plurality of nozzle outlets (106*a*, 106*b*); and
at least two pilot nozzles (102*a*, 102*b*);
at least one flame front nozzle (36);
wherein the pilot nozzle assembly (102) is in fluid communication with said pilot inlet pipe (110);
wherein said pilot assembly (100) further comprises a flame front deflector (130) provided between the at least two pilot nozzles (102*a*, 102*b*); and
wherein the flame front deflector (130) is positioned within the pilot assembly (100) to deflect a flame front FF from said at least one flame front nozzle (36) towards said pilot nozzles (102*a*, 102*b*).

2. The pilot assembly (100) of claim 1 wherein the at least two pilot nozzles (102*a*, 102*b*) each terminate in one of said plurality of nozzle outlets (106*a*, 106*b*); and
wherein the connecting member (103) comprises a plurality of conduits (103*a*, 103*b*) fluidly connecting the pilot nozzle inlet (104) and the pilot nozzles (102*a*, 102*b*).

3. The pilot assembly (100) of claim 2 wherein the at least two pilot nozzles (102*a*, 102*b*) each further comprise at least one flame front opening (108).

4. The pilot assembly (100) of claim 3 wherein the pilot ignition system (30) further comprises:
a flame front generator (32); and
a single ignition line (34).

5. The pilot assembly (100) of claim 4 wherein the connecting member (103) receives a quantity of pilot gas from said pilot inlet pipe (110) via the single pilot nozzle inlet (104);
wherein the connecting member (103) then directs substantially all of said quantity of pilot gas to the at least two pilot nozzles (102*a*, 102*b*) via the plurality of conduits (103*a*, 103*b*); and
wherein the at least two pilot nozzles pilot nozzles (102*a*, 102*b*) then direct substantially all of said quantity of pilot gas out through their respective nozzle outlets (106*a*, 106*b*).

6. A pilot assembly (100) for use with a flare stack (10) having a first flare stack (10*a*) and a second flare stack (10*b*), each of the first flare stack (10*a*) and a second flare stack (10*b*) comprising a flare (12) having a discharge end (18), the pilot assembly (100) comprising:
a pilot nozzle assembly (102);
a pilot inlet pipe (110) having a pilot fuel inlet (120); and
a pilot ignition system (30);
wherein the pilot nozzle assembly (102) comprises:
a connecting member (103);
a single pilot nozzle inlet (104); and
a plurality of nozzle outlets (106*a*, 106*b*);
at least one flame front nozzle (36);
wherein the pilot nozzle assembly (102) is in fluid communication with said pilot inlet pipe (110);
wherein the pilot nozzle assembly (102) further comprises a first pilot nozzle (102*a*) and a second pilot nozzle (102*b*);
wherein said pilot assembly (100) further comprises a flame front deflector (130) between the first pilot nozzle (102*a*) and the second pilot nozzle (102*b*);
wherein the connecting member (103) comprises a plurality of conduits (103*a*, 103*b*) fluidly connecting the pilot nozzle inlet (104) to the first pilot nozzle (102*a*) and the second pilot nozzle (102*b*); and
wherein the flame front deflector (130) is positioned within the pilot assembly (100) to deflect a flame front FF from said at least one flame front nozzle (36) towards said pilot nozzles (102*a*, 102*b*).

7. The pilot assembly (100) of claim 6 wherein the first pilot nozzle (102*a*) is positioned adjacent the discharge end (18) of the first flare stack (10*a*); and wherein the second pilot nozzle (102*b*) is positioned adjacent the discharge end (18) of the second flare stack (10*b*).

8. A pilot nozzle assembly (102) for use with a pilot assembly (100) of a flare stack (10) having a flare (12) with a discharge end (18), the pilot nozzle assembly (102) comprising:

a connecting member (103);

a single pilot nozzle inlet (104);

a plurality of nozzle outlets (106*a*, 106*b*);

at least two pilot nozzles (102*a*, 102*b*) each terminating in one of said plurality of nozzle outlets (106*a*, 106*b*); and at least one flame front nozzle (36);

wherein the connecting member (103) comprises a plurality of conduits (103*a*, 103*b*) fluidly connecting the pilot nozzle inlet (104) and the pilot nozzles (102*a*, 102*b*);

wherein said nozzle assembly (102) further comprises a flame front deflector (130) between the first pilot nozzle (102*a*) and the second pilot nozzle (102*b*);

wherein said plurality of nozzle outlets (106*a*, 106*b*) may be directed to said discharge end (18) of the flare (12)); and wherein the flame front deflector (130) is positioned within the pilot assembly (100) to deflect a flame front FF from said at least one flame front nozzle (36) towards said pilot nozzles (102*a*, 102*b*).

* * * * *